United States Patent [19]

Protz, Jr.

[11] Patent Number: 4,625,865

[45] Date of Patent: Dec. 2, 1986

[54] DISPLAY PACKAGE FOR GARLAND OR THE LIKE

[76] Inventor: William F. Protz, Jr., 528 N. 7th St., Manitowoc, Wis. 54220

[21] Appl. No.: 731,106

[22] Filed: May 6, 1985

[51] Int. Cl.[4] ..... B65D 85/04; B65H 55/02

[52] U.S. Cl. ..... 206/388; 206/485; 206/495; 242/50

[58] Field of Search ..... 206/388, 49, 485, 480, 206/492, 442, 495; 229/87 R; 242/50, 61, 222

[56] References Cited

U.S. PATENT DOCUMENTS

| | | | |
|---|---|---|---|
| 897,173 | 8/1908 | Strassberger | 206/388 |
| 1,171,194 | 2/1916 | Hammond-Knowlton | 206/388 |
| 1,441,266 | 1/1923 | Clune | 206/49 |
| 1,906,055 | 4/1933 | Goldsmith et al. | 242/50 |
| 1,957,256 | 5/1934 | Frey | 206/457 |
| 3,696,918 | 10/1972 | Lerner | 206/388 |
| 3,971,527 | 7/1976 | Maye | 242/50 |
| 4,190,151 | 2/1980 | Russell | 206/459 |
| 4,437,618 | 3/1984 | Boyle | 206/49 |
| 4,508,223 | 4/1985 | Catrambone | 206/485 |

FOREIGN PATENT DOCUMENTS

| | | | |
|---|---|---|---|
| 364690 | 6/1920 | Fed. Rep. of Germany | 206/49 |
| 344976 | 11/1904 | France | 206/49 |

*Primary Examiner*—William Price
*Assistant Examiner*—Brenda J. Ehrhardt
*Attorney, Agent, or Firm*—James & Franklin

[57] ABSTRACT

An open-faced frame supports and protects a continuous strand of garland. The strand is wound around a pair of spaced, oppositely oriented "V"-shaped strand support members. Each of the support members has two hingeably joined portions, each with a peripheral edge. A plurality of strand receiving recesses are situated along each peripheral edge. The support members are retained in parallel relation by two spaced, substantially planar elements. Openings on the ends of each element receive and retain the support members. A band encircles the elements and a portion of the strand therebetween. The frame is virtually hidden from view by the garland, but protects same from being flattened or crushed during handling, shipping, and display.

16 Claims, 6 Drawing Figures

DISPLAY PACKAGE FOR GARLAND OR THE LIKE

The present invention relates to packaging for strands of crushable material such as garland or the like and, more particularly, to a frame package which both protects and displays the strand material and which is relatively inexpensive to produce and easy to assemble.

Garland is a commonly used Christmas Tree ornamentation which is sold in multi-foot strands consisting of a central thread with a plurality of radially extending flexible tines. Garland is sold in various colors, patterns, and lengths.

Conventional methods of retail packaging of garland are boxing and banding. These methods have been the standard methods of packaging in the industry for many years.

Boxed garlands are typically wound around a flat chipboard insert which is designed to be supported at the mid-point of the box. This is the most protective of the current methods for packaging. However, even with this method of packaging, some product deterioration occurs mainly due to flattening or kinking of the product where it makes an abrupt 180° turn around the insert ends. Moreover, the boxed method is the most costly of the current methods of packaging and takes the most retail shelf space. Due to these reasons, less than ten percent (10%) of the garlands sold are packaged in boxes.

Banding the garland is the most popular method of packaging garland because it is the least expensive. In this method, the garland is wound around a chipboard or corrugated insert and banded around the middle with a printed band which holds the product in place and provides the product identification information. The garland is wound in one to three layers on the insert.

The bottom layer is wound against the flat surface of the insert and additional layers are wound over it. Significant flattening of the bottom layer occurs where it is wound against the flat surface of the insert, particularly when additional layers are wound on the top. Flattening also occurs within the layers since they rest directly on each other. The printed bands also cause flattening where they are wrapped tightly around the insert. Kinks and some additional flattening occur at the insert ends where the garland makes an abrupt 180° turn. Moreover, banded garland is subject to being crushed in the shipping container that each piece is compressed against the adjacent piece.

It is, therefore, a prime object of the present invention to provide a display package for garland or the like which provides the protection of a box at substantially reduced cost.

It is another object of the present invention to provide a display package for garland or the like wherein flattening of the garland against an insert is eliminated.

It is another object of the present invention to provide a display package for garland or the like in which flattening by the band encircling the garland is eliminated.

It is another object of the present invention to provide a display package for garland or the like in which kinks and flattening occurring at the ends of an insert are eliminated.

It is another object of the present invention to provide a display package for garland or the like which protects the garland during shipping.

It is another object of the present invention to provide a display package for garland or the like of relatively simple construction which is made out of inexpensive materials and can be assembled at a moderate price.

In accordance with one aspect of the present invention, a package for a strand of crushable material such as garland or the like is provided. The package includes open-faced frame means which comprise first and second strand support members and means for retaining the members in substantially parallel, spaced relation, such that the strand can be wrapped therearound. The retaining means comprises first and second spaced, substantially parallel retaining elements and means for mounting said members proximate the ends of the elements.

The package further comprises means, mounted to and extending between the elements, for encircling the portion of the strand between the elements. The encircling means preferably comprises a band.

The elements each comprise a band support portion. The band support portions comprise means for preventing movement of the band relative to the element. The band support portions are preferably wide enough to protect side-by-side lengths of the strand.

Each of the members has a plurality of strand receiving recesses located along the periphery thereof. Selected ones of the strand receiving recesses are offset with respect to adjacent recesses.

Each of the members includes first and second portions, each of the portions having a peripheral edge. The peripheral edges are spaced from each other. The peripheral edges have a plurality of strand receiving recesses thereon.

Each of the elements comprises first and second portions. Means are provided for hingeably joining the protions.

The mounting means comprises an opening proximate each end of each of the elements. Each of the members is adapted to be received within the openings.

Tab means are preferably provided extending from one of the members. The tab means comprises an opening to permit the package to be suspended on a display rack or the like.

The support members include portions which extend outwardly beyond the elements. These portions are provided with strand receiving recesses.

In accordance with another aspect of the present invention, a package is provided for a strand of crushable material such as garland or the like. The package comprises open-faced frame means. The frame means comprises first and second strand support members. Each of the members comprises first and second hingeably joined portions. Each of the portions has a peripheral edge. A plurality of strand receiving recesses are situated along each of the peripheral edges. Means are provided for retaining the members in oppositely oriented, substantially parallel, spaced relation such that the strand can be wrapped therearound. The retaining means comprises first and second spaced, substantially parallel retaining elements. Each of the elements has a substantially planar configuration. Openings are provided on the elements for receiving and retaining the members proximate the ends thereof. A band is provided for encircling the elements and the portion of the strand therebetween.

To these and to such other objects which may hereinafter appear, the present invention relates to a display package for garland or the like, as described in the following specification and set forth in the annexed claims, taken together with the accompanying drawings, wherein like numerals refer to like parts and in which:

Figure 1:
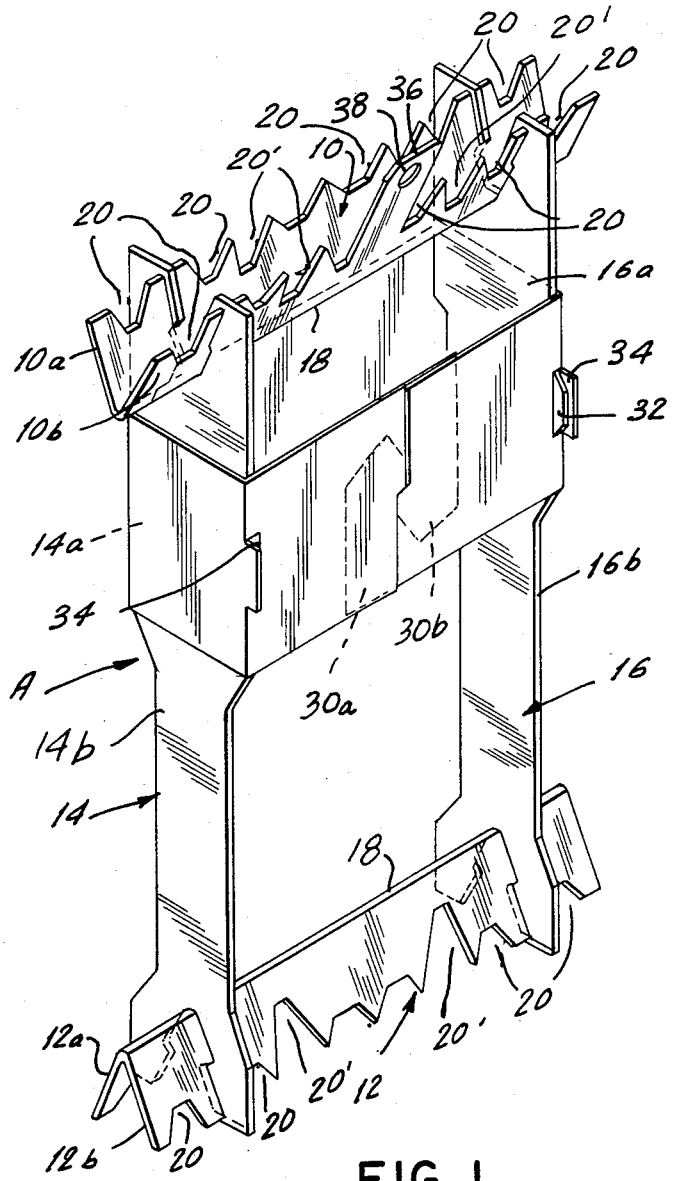
FIG. 1 is an isometric view of the rear of the package of the present invention without the strand of garland situated thereon.

As shown in the drawings, the package of the present invention comprises an open-faced frame-like structure, generally designated A. Frame-like structure A comprises first and second strand support members 10, 12 in substantially parallel, spaced relation, such that the strand of garland can be wrapped therearound. The retaining means comprises first and second substantially parallel retaining elements 14, 16. Means, in the form of openings 24, are provided at the ends of each of the elements 14 and 16 for mounting the members 10 and 12 thereon. Members 10, 12, 14, and 16 are preferably formed by die-cutting planar sheets of corrugated cardboard or other relatively rigid paper product.

Each of the members 10 and 12 is a single planar member which has been bent along a fold line 18 to create two hingeably joined portions which appear in a "V"-shaped configuration in end view. Portions 10*a* and 10*b* are the mirror image of each other (with the exception of tab 36 noted below), as are portions 12*a* and 12*b*.

Each of the portions 10*a*, 10*b* and 12*a*, 12*b* has a peripheral edge along which a plurality of spaced strand receiving recesses 20 are formed. The recesses 20 on each portion are aligned with the recesses on the corresponding portion. However, the bottom walls of certain of the recesses 20' are offset with respect to adjacent recesses so that the spacing between adjacent lengths of the garland is adequate to prevent flattening. The recesses serve to position the strand and prevent lateral movement of the strand with respect to members 10 and 12.

It should be noted that no flattening or kinking of the garland can occur at the ends of the frame where the strand is supported by members 10 and 12. Unlike packaging where the strand is wrapped around a planar insert, there are no abrupt 180° turns in the path of the strand. Instead, the strand goes through two 90° turns, one at the peripheral edge of each portion, eliminating kinking and flattening at the ends of the frame.

Figure 3:
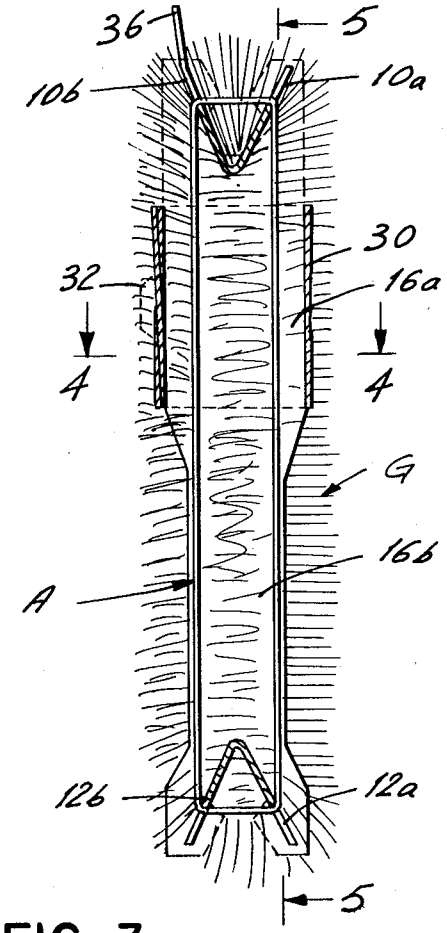
FIG. 3 is a cross-sectional view taken along line 3—3 of FIG. 2.
Figure 6:
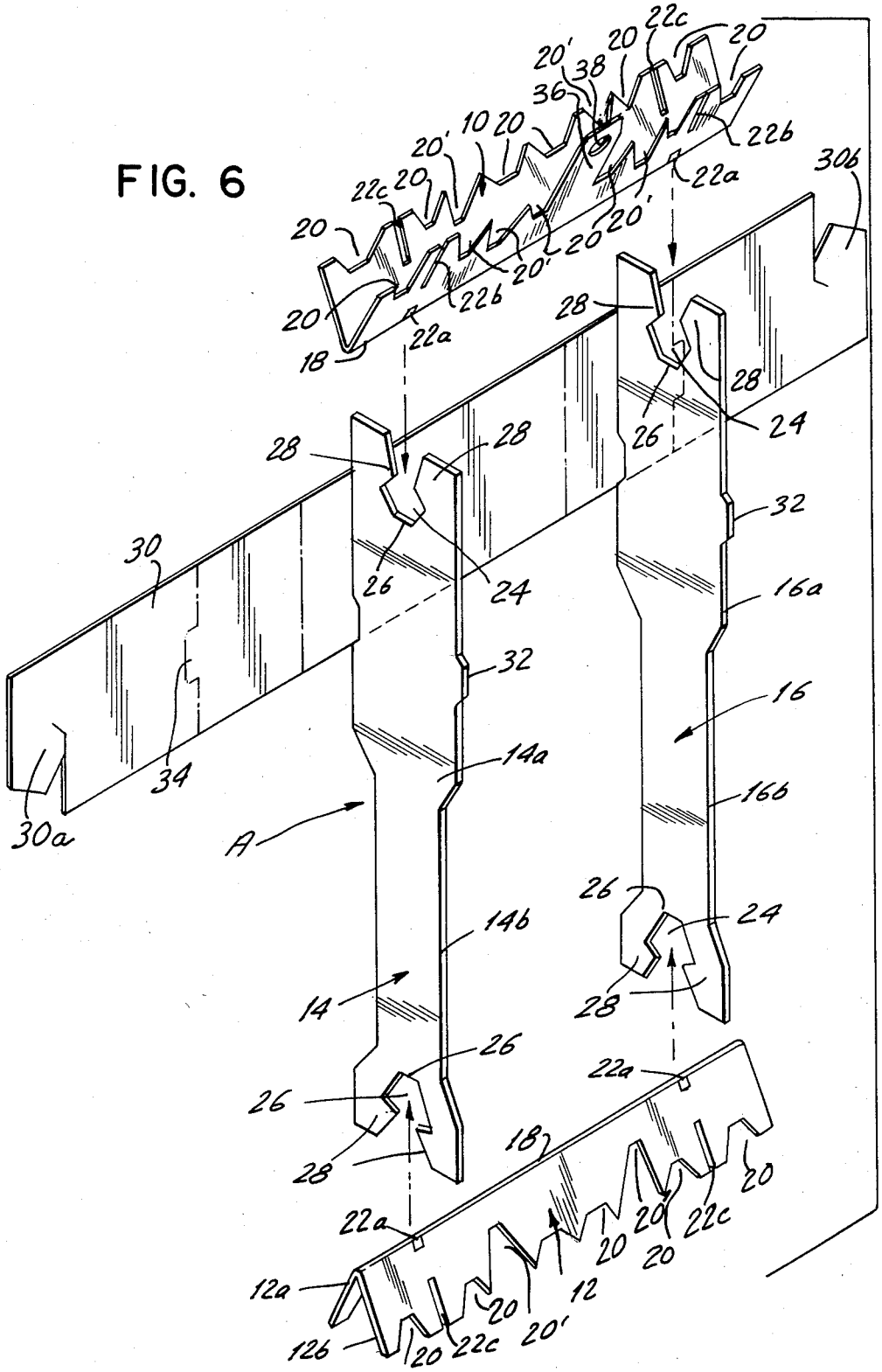
FIG. 6 is an exploded isometric view of the package of the present invention.

At the top and bottom of each of the elements 14 and 16 is provided a generally triangular-shaped opening 24 into which one of the members 10, 12 is situated. As best seen in FIG. 3, each opening 24 actually has a flat interior wall 26 and a pair of inwardly extending side projections 28 spaced from wall 26. Members 10 and 12 are provided with a slot 22*a* extending across and beyond the fold line 18 within which wall 26 is received. In addition, the peripheral edge of each of the members is provided with an inwardly extending slot 22*b*, 22*c* aligned with the bottom slot 22*a*, into which the inwardly extending projections 28 are received. The above structure permits members 10 and 12 to be securely mounted to each of the elements 14, 16 in an inexpensive and simple manner.

Members 10 and 12 are inserted into openings 24 by positioning the portions thereof in side-by-side relation and inserting the member into opening 24 such that wall 26 is received in slot 22*a*. The portions of the member are then released such that the portions spread outwardly and projections 28 are received in slots 22*b* and 22*c*.

Figure 4:
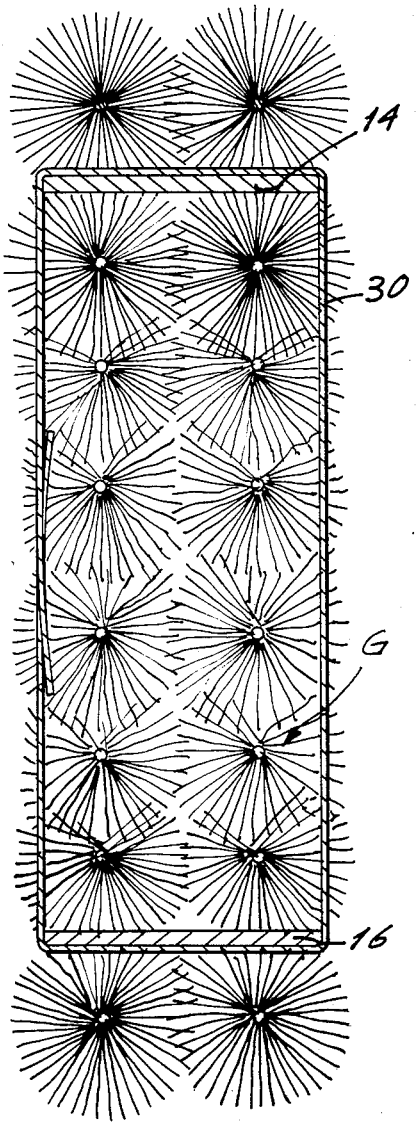
FIG. 4 is a cross-sectional view taken along line 4—4 of FIG. 3.

Each of the elements 14 and 16 is cut from thick paper or thin cardboard stock and is substantially planar. Each has a wider portion 14*a*, 16*a*, and a narrower portion 14*b*, 16*b*. The width of the wider portions 14*a*, 16*a* is wide enough such that two lengths of the strand can be situated between the front and rear edges of the wider portions 14*a* and 16*a* without substantial flattening. This permits a band 30 to encircle the wider portions 14*a* and 16*a* without flattening the strands substantially, as best seen in FIG. 4.

Figure 2:
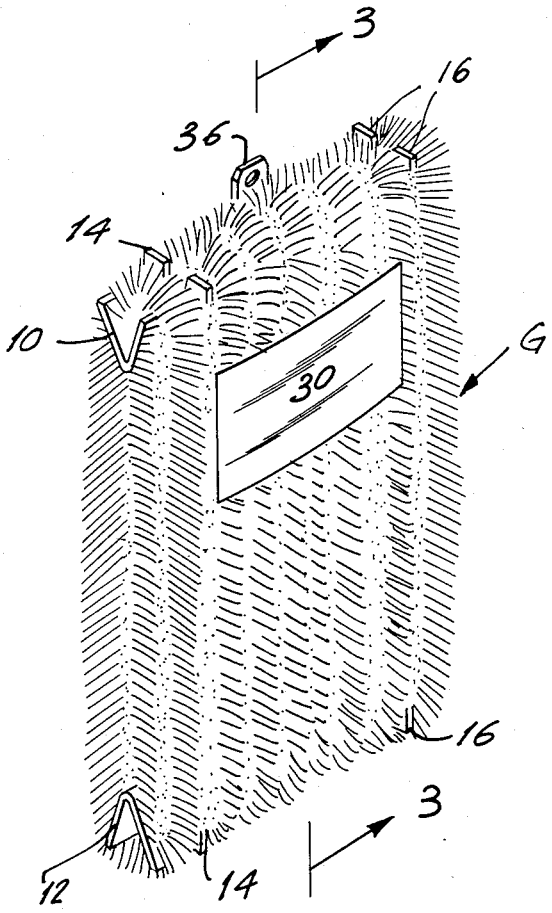
FIG. 2 is an isometric view of the package of the present invention showing the garland situated thereon.

Portions proximate the ends of each of the members 10 and 12 extend beyond the exterior surfaces of the elements 14 and 16 and are provided with strand receiving recesses 20. These portions permit lengths of the strand to be situated adjacent the exterior surface of elements 14 and 16, as well as adjacent the interior surfaces, such that virtually the entire frame A is obstructed from view when the garland is in place, as seen in FIG. 2. These portions also protect the externally mounted lengths of strand from being flattened or crushed by external forces from the sides of the package.

Band or encircling element 30 extends around elements 14 and 16, surrounding the lengths of the strand situated therebetween. Band 30 is preferably a single sheet of paper product having engageable tongues 30*a* and 30*b* at the ends thereof. Preferably, openings 34 are provided at the rear of the band, in alignment with the rear edge of each of the elements 14 and 16. The rear edge of each of the elements 14 and 16 are provided with a tab 32 which is received within the openings 34 so as to position band 30 and to prevent relative movement between the band and elements 14 and 16. The front face of band 30 is available for imprinting product related indicia such as the identification of the product, the name of the manufacturer, and the length of the strand being sold, etc.

The structure of the display package of the present invention protects the garland during shipping. In the shipping container, packages are stacked on each other. When the conventional banding method is used, the garland is crushed between adjacent inserts by the weight of the stack. In the present invention, the packages are stacked frame on frame so no garland is sandwiched in between. The bands insure that adjacent frames will not nest into each other and crush the garland.

A tab member 36 is preferably provided extending from member 10. Tab 36 is provided with an opening 38 therein. Opening 38 is adapted to receive a rod or the like from a display rack such that the package of the present invention can be hung from a display rack.

After the frame is assembled, by affixing members 10 and 12 to elements 14 and 16, a strand of garland is wrapped therearound by inserting the strand within the various strand receiving openings as the garland is wound from one side of the frame to the other. Unlike a conventional planar insert, there are no abrupt turns which tend to crush portions of the strand. There are also no insert surfaces to produce flattening.

Figure 5:
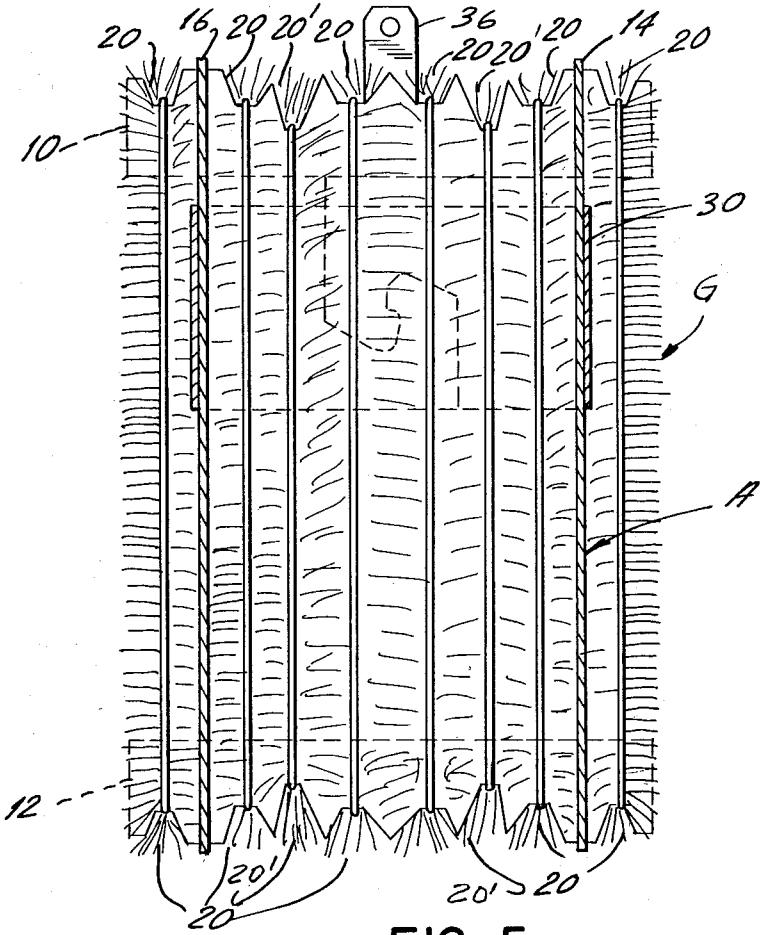
FIG. 5 is a cross-sectional view taken along line 5—5 of FIG. 3.

After the garland is completely wound on the frame, band 30 is positioned in place with respect to elements 14 and 16, by putting tabs 32 through openings 34, and tongues 30*a*, 30*b* are engaged. Band 30 thus encircles elements 14 and 16 as well as the strands of garland therein, as best seen in FIGS. 3, 4, and 5. Since the width of each of the wider portions 14*a* and 16*a* of elements 14 and 16 is sufficient to permit side-by-side lengths of the strand to be situated between its edges without crushing, the lengths enclosed within band 30 will not be crushed by the band. The structure of the frame acts to protect the garland from being crushed by external forces.

As seen in FIG. 2, the frame is not readily visible once the garland is in place, except for the front portion of band 30 which contains identifying indicia. However, the garland is completely protected from being crushed by outside forces, applied vertically, horizontally, or perpendicular to the plane of the frame. The package is completely self-supporting and can be displayed directly on a conventional display rack by means of tab 36 or stacked on shelves or the like.

It will now be appreciated that the present invention relates to a package for strand material such as garland or the like which is aesthetically pleasing, inexpensive to manufacture, easy to assemble and which protects the strand material from being crushed during handling, shipment or display. In addition, it provides a convenient means for displaying the product without obstructing it from view.

Kinking and flattening, normally associated with abrupt turns in the path of the strand at the opposite ends of a planar insert, is eliminated by utilizing "V"-shaped support members with spaced peripheral edges. The configuration of the present invention also eliminates flattening normally associated with the surfaces of an insert.

Flattening caused by the application of external forces is eliminated by providing a frame structure which resists compression, but, at the same time, permits full display of the product. In particular, in the shipping container, the packages rest frame on frame providing space such that no garland is sandwiched in between, as with the conventional banded packaging method. Thus, protection against flattening similar to that attained through the use of a fully enclosing box is achieved at a small fraction of the cost.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A package for a strand of crushable material or the like comprising first and second strand support members and means for retaining said members in spaced relation such that the strand can be wrapped therearound, said retaining means comprising first and second spaced, substantially parallel retaining elements, and means for mounting said members proximate the ends of said elements, said mounting means comprising an opening proximate each end of each of said elements, each of said members having portions adapted to be received within said openings.

2. A package for a strand of crushable material or the like comprising first and second strand support members and means for retaining said members in spaced relation such that the strand can be wrapped therearound, said retaining means comprising first and second spaced, substantially parallel retaining elements, said elements having oppositely oriented exterior surfaces, and means for mounting said members proximate the ends of said elements, said support members comprising portions which extend outwardly beyond said exterior surfaces of said elements.

3. A package for a strand of crushable material or the like comprising first and second strand support members and means for retaining said members in spaced relation such that the strand can be wrapped therearound, said retaining means comprising first and second spaced elements and means for mounting said members proximate the ends of said elements, said members having substantially "V"-shaped cross-sections, each being formed of first and second portions hingeably joined together, said members being mounted to said elements in substantially opposite orientation.

4. The package of any one of claims 1, 2, or 3, further comprising means, mounted to and extending between said elements, for encircling a portion of the strand.

5. The package of claim 4, wherein said encircling means comprises a band.

6. The package of claim 5, wherein said elements each comprise a band support portion.

7. The package of claim 6, wherein said band support portions comprise means for preventing movement of the band relative to the element.

8. The package of claim 7, wherein said band support portions are wide enough to protect side-by-side lengths of said strand.

9. The package of any one of claims 1, 2, or 3, wherein each of said members has a plurality of strand receiving recesses located along the periphery thereof.

10. The package of claim 9, wherein one of said strand receiving recesses is offset with respect to the adjacent recesses.

11. The package of claim 1 or claim 2, wherein each of said members comprises first and second portions, each of said portions having a peripheral edge and wherein said peripheral edges are spaced from each other.

12. The package of claim 11, wherein said peripheral edges have a plurality of strand receiving recesses thereon.

13. The package of claim 1 or claim 2, wherein each of said members comprises first and second portions and means for hingeably joining said portions.

14. The package of claim 2 or claim 3, wherein said mounting means comprises an opening proximate each end of each of said elements, each of said members having portions adapted to be received within said openings.

15. The package of any one of claims 1, 2 or 3, further comprising tab means extending from one of said members, said tab means comprising an opening.

16. The package of claim 3, further comprising strand receiving recesses on said portions.

* * * * *